US006854947B2

(12) United States Patent
Lee

(10) Patent No.: US 6,854,947 B2
(45) Date of Patent: Feb. 15, 2005

(54) METHOD OF MANUFACTURING AN ALUMINUM DESIGN TAB END FOR A BEVERAGE CAN

(75) Inventor: Do Hee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/475,209

(22) PCT Filed: Apr. 20, 2002

(86) PCT No.: PCT/KR02/00731

§ 371 (c)(1),
(2), (4) Date: Oct. 17, 2003

(87) PCT Pub. No.: WO02/085628

PCT Pub. Date: Oct. 31, 2002

(65) Prior Publication Data

US 2004/0123444 A1 Jul. 1, 2004

(30) Foreign Application Priority Data

Apr. 20, 2001 (KR) ..... 2001-21328

(51) Int. Cl.[7] ..... B21D 51/38

(52) U.S. Cl. ..... 413/3; 413/12; 413/18; 413/25

(58) Field of Search ..... 413/1, 3, 7, 12, 413/14, 18, 25; 40/306; 156/230, 237, 240, 277, 244.16; 220/269, 270; 29/458, 527.2

(56) References Cited

U.S. PATENT DOCUMENTS 4,380,129 A * 4/1983 Barrash ..... 40/307
4,762,579 A * 8/1988 Shimizu et al. ..... 156/69
5,191,695 A * 3/1993 Pavely et al. ..... 29/451
5,359,766 A * 11/1994 Pavely et al. ..... 29/564.6
5,511,920 A * 4/1996 Artrip ..... 413/25
5,799,815 A * 9/1998 Lang ..... 220/258.5
6,105,806 A * 8/2000 Stasiuk ..... 220/269

* cited by examiner

*Primary Examiner*—Allen Ostrager
*Assistant Examiner*—Jimmy Nguyen
(74) *Attorney, Agent, or Firm*—Lee, Hong, Degerman, Kang & Schmadeka

(57) ABSTRACT

The present invention relates to a method for manufacturing a design tab end of a beverage can, in which a base color is painted on an aluminum tab coil before forming a tab, and a design is printed on the surface of the tab coil on which the base color has been painted, thereby making the color of the tab gorgeous and raising the value of the product. The present invention is comprised of the steps of, painting a base color on an exact surface position of an aluminum tab coil that is to be formed to a tab through the tab forming process; printing a design on the surface of the tab coil on which the base color has been painted, according to a printing degree; coating a varnish for preventing a deterioration of printing quality during forming and distribution of a product, on the surface of the tab coil on which the design has been printed; arranging a pitch of the tab coil so as to determine an exact position of the tab coil that has been coated with the varnish; press-forming the arranged tab coil with a conversion press; and stacking the tab formed by the press-forming to join the tab on a center of a shell that has been fed previously.

2 Claims, 3 Drawing Sheets

METHOD OF MANUFACTURING AN ALUMINUM DESIGN TAB END FOR A BEVERAGE CAN

BACKGROUND OF THE INVENTION

1. Field of the Invention

The present invention relates to a method for manufacturing a design tab end of a beverage can, and more particularly, to a method for manufacturing a design tab end of a beverage can, in which a base color is painted on an aluminum tab coil before forming a tab, and a design is printed on the surface of the tab coil on which the base color has been painted, thereby making the color of the tab gorgeous and raising the value of the product.

2. Description of the Related Art

A beverage can is generally used with the advantages that the beverage is able to be preserved for a long period of time and it can be used easily, and the beverage can is used for containing soda water, fruit beverage, mixed beverage as well as beer. The beverage can is generally comprised of a cylindrical body made of a metallic material excluding iron, such as steel or aluminum, and an aluminum end seamed on the upper side of the body. The aluminum end is formed with a score line so that the opening of the beverage can is torn easily. Further, a tab for opening the beverage can by pushing the score line is joined on the end.

Thus, in order to drink the contents in the beverage can, the score line formed on the end has to be torn by pulling the tab. In this situation, the beverage in the can is discharged through the outlet formed by the torn score line, so a man can drink the beverage conveniently.

The present invention is related to the manufacturing method for producing a design tab end of the beverage can that can function as an ornament by applying a design on the tab joined on the end, where the design includes a logo of the beverage brand, an image, advertising words, a suggestive word about the property of the product, a variety of animation characters for the promotion of the product, a caricature of a figure, an image of a fruit in case of a fruit beverage, a logo and a mascot of a sports game, or a logo and a trademark of a company.

One of the conventional arts for giving an ornamental function to the tab has been disclosed on the U.S. Pat. No. 4,380,129 applied by Coca Cola. In the method disclosed in the same, various information is applied on the tab after forming the tab, however, according to the current manufacturing process of the can end, the productivity becomes lowered seriously if the information is applied on the tab after the tab is formed completely.

In the mean time, there has been proposed an ornamentation method using a laser etching technology. But it also has a problem of high cost caused by the laser etching process, so it is inappropriate for the mass production.

To solve the above problems, the applicant of the present invention has proposed a manufacturing method of a design tab end in the Korean Patent Application No. 2001-8020 filed on Feb. 17, 2001, in which a tab coil is painted with a base color, printed with a design and varnished, and then the tab coil is fed to a tab forming process and a conversion press process that is a stacking process, by using a pitch arrangement tool.

However, the tab end manufacturing method that a design is printed separately after the base color is painted is, in manufacturing a design tab end made of aluminum which does not need a anticorrosive process, comprised of the steps for printing a desired design after the base color is firstly painted on an exact part of the tab coil to be formed to a tab in the tab forming process, coating a varnish for preserving the printing quality, arranging the pitch of the varnished tab coil, forming the designed aluminum tab with a conversion press, and joining the designed aluminum tab on a fed shell. However, such a method has disadvantages in the productivity and cost-saving aspects, in comparison with a unified method that the base color painting process and the tab design printing process are performed in a single process.

SUMMARY OF THE INVENTION

The present invention has been proposed to solve the above problems, and it is an object of the present invention to provide a method for manufacturing a design tab end of a beverage can, which can improve the productivity and exactness, by painting a base color and printing the design after arranging the position of the base color of the printed tab to be an exact position and intervals with a tab arrangement tool before a tab forming process of a conversion press in case of a tab of which curl part is close, coating a varnish on the tab coil printed with the design with the same pitch as the printing process, and then forming the tab with the same pitch.

The above object can be accomplished by the method for manufacturing a design tab end of a beverage can according to the present invention, which comprises the steps of: painting a base color on an exact surface position of an aluminum tab coil that is to be formed to a tab through the tab forming process; printing a design on the surface of the tab coil on which the base color has been painted, according to a printing degree; coating a varnish for preventing a deterioration of printing quality during forming and distribution of a product, on the surface of the tab coil on which the design has been printed; arranging a pitch of the tab coil so as to determine an exact position of the tab coil that has been coated with the varnish; press-forming the arranged tab coil with a conversion press; and stacking the tab formed by the press-forming to join the tab on a center of a shell that has been fed previously, wherein the step of painting the base color, the step of printing the design, and the step of coating to preserve the printing quality are performed in a single process by a unified design tab printer using a pitch arrangement tool.

BRIEF DESCRIPTION OF THE DRAWINGS

The above-mentioned object and feature of the present invention will be more apparent by describing the preferred embodiment of the present invention by referring to the accompanying drawings, in which.

DETAILED DESCRIPTION OF THE PREFERRED EMBODIMENT

Figure 1:
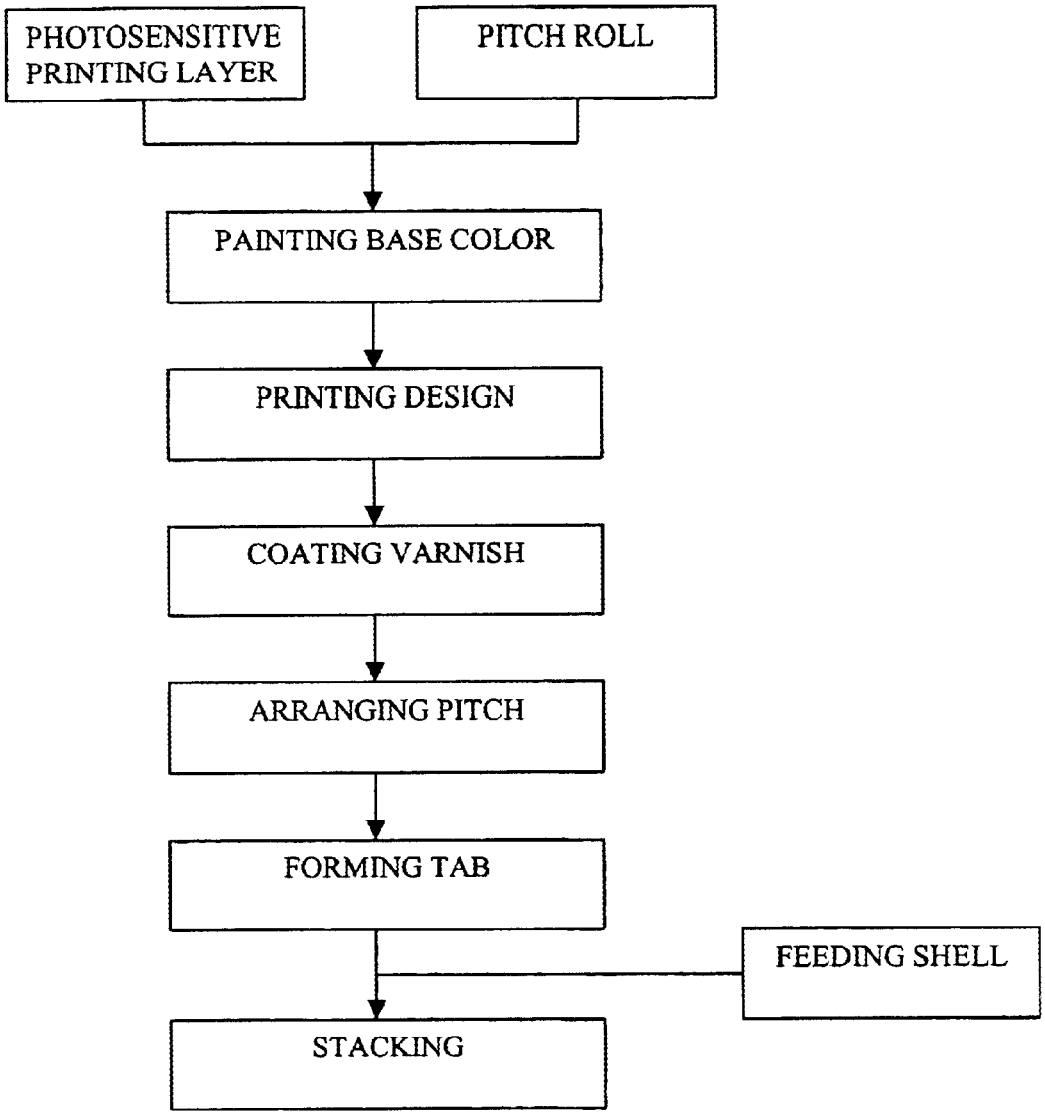
FIG. 1 is a flow chart for illustrating the method for manufacturing a designed aluminum tab of a beverage can according to the present invention.

Hereinafter, the method for manufacturing a design tab end of a beverage can according to the preferred embodiment of the present invention is described in detail with reference to FIG. 1.

In order to improve the productivity and save the costs in printing the design such as a logo of a company or a mascot on the surface of the tab of which curl part is close, the preferred embodiment of the present invention propose the method, where the position of the base color printed on the surface of the tab and the position of the design are arranged on the desired position of the tab to be formed afterwards by a pitch arrangement tool, and the tab printing process is performed in such a status, and then the tab coil of which printing process has been completed undergoes a varnish coating process with the same pitch as the printing process. Then, the tab coil is fed to a forming process with the same pitch, whereby the painting process of the base color of the tab, printing process of the design, and the varnish coating process to preserve the printing quality are performed in a single process by a unified design tab printer. Then, a tab forming process and a stacking process are performed by a conversion press to complete the manufacturing of the tab end for the beverage can.

In such a situation, if the pitch is not arranged exactly, the tab punching process of the conversion press is not performed on the exact position, so the painting of the base color, printing of the design by the inkjet printing, and varnish coating are performed before the tab punching, after the pitch has been arranged by the pitch arrangement tool.

Hereinafter, the above processes are described in more detail.

As the aluminum tab coil is drawn little by little from a photosensitive printing layer or an aluminum pitch roll on which the aluminum tab coil is wound like a roll, both sides of the aluminum tab coil are painted with a desired base color.

Next, the surface of the tab coil painted with the base color is printed with multi-color. In such a situation, for the printing of the design, multiple printing rollers are disposed and oil ink or UV ink is supplied to the surface of the rollers continuously from an ink supply container. Therefore, while the tab coil painted with the base color is traveling between the multiple rollers, both sides of the coil are printed with the oil ink or the UV ink, to form the design such as a pattern, a logo, or a mascot.

The tab coil printed with the design undergoes the varnish coating in order to protect the design printed on the surface thereof while the tab is being formed and the product is being distributed. In the varnish coating process, it is preferable to use UV painting material for protecting from ultraviolet rays or anticorrosive material of rapid-drying property. At this time, the coating process is performed using the multiple rollers, and both sides of the coil are coated while the coating material such as the UV painting material or the anticorrosive material of rapid-drying property is supplied continuously.

In such a situation, the tab printing process is performed while the tab is arranged by a pitch arrangement tool so that the position of the base color of the tab is exactly arranged on the desired position of the tab to be formed, and the tab coil printed with the design undergoes the varnish coating with the same pitch as the printing process.

After the completion of the varnish coating, the tab coil, of which pitch has been arranged to be the same as that in the printing process and the varnish coating process, is conveyed to the tab forming process by a belt conveyer, and then is press-formed to a predetermined tab shape by the conversion press.

Then, the tab formed by the conversion press is stacked by being joined on the center of the shell that has been fed previously.

The summarized process of the tab manufacturing method is as follows.

The present invention is comprised of the steps of: painting a base color on an exact surface position of an aluminum tab coil that is to be formed to a tab through the tab forming process; printing a design on the surface of the tab coil on which the base color has been painted, according to a printing degree; coating a varnish for preventing a deterioration of printing quality during forming and distribution of a product, on the surface of the tab coil on which the design has been printed; arranging a pitch of the tab coil so as to determine an exact position of the tab coil that has been coated with the varnish; press-forming the arranged tab coil with a conversion press; and stacking the tab formed by the press-forming to join the tab on a center of a shell that has been fed previously, wherein the step of painting the base color, the step of printing the design, and the step of coating to preserve the printing quality are performed in a single process by a unified design tab printer using a pitch arrangement tool.

Furthermore, in order to secure the space to apply the design when forming the tab of which curling part is close, the present invention provides an apparatus for forming the tab for a beverage can, which can prevent the movement of the tab so as not to form a matching hole for inserting a pilot pin to the tab coil, and can adjust the length of the pilot pin when required.

To achieve such an object, the present invention provides an apparatus for manufacturing a tab of a beverage can with an upper mold and a lower mold, wherein a plurality of pilot pins for preventing the movement of the tab disposed on the lower mold are installed vertically and downwardly on the upper mold, a casing is attached to the upper end of the upper mold, a spring for pressing the pilot pin is installed in the casing, and an adjusting bolt for adjusting the elastic force of the spring is screwedly assembled with the upper part of the casing.

Hereinafter, the construction of the tab forming apparatus according to the preferred embodiment of the present invention is described in detail with reference to FIGS. 2 and 3.

Figure 2:
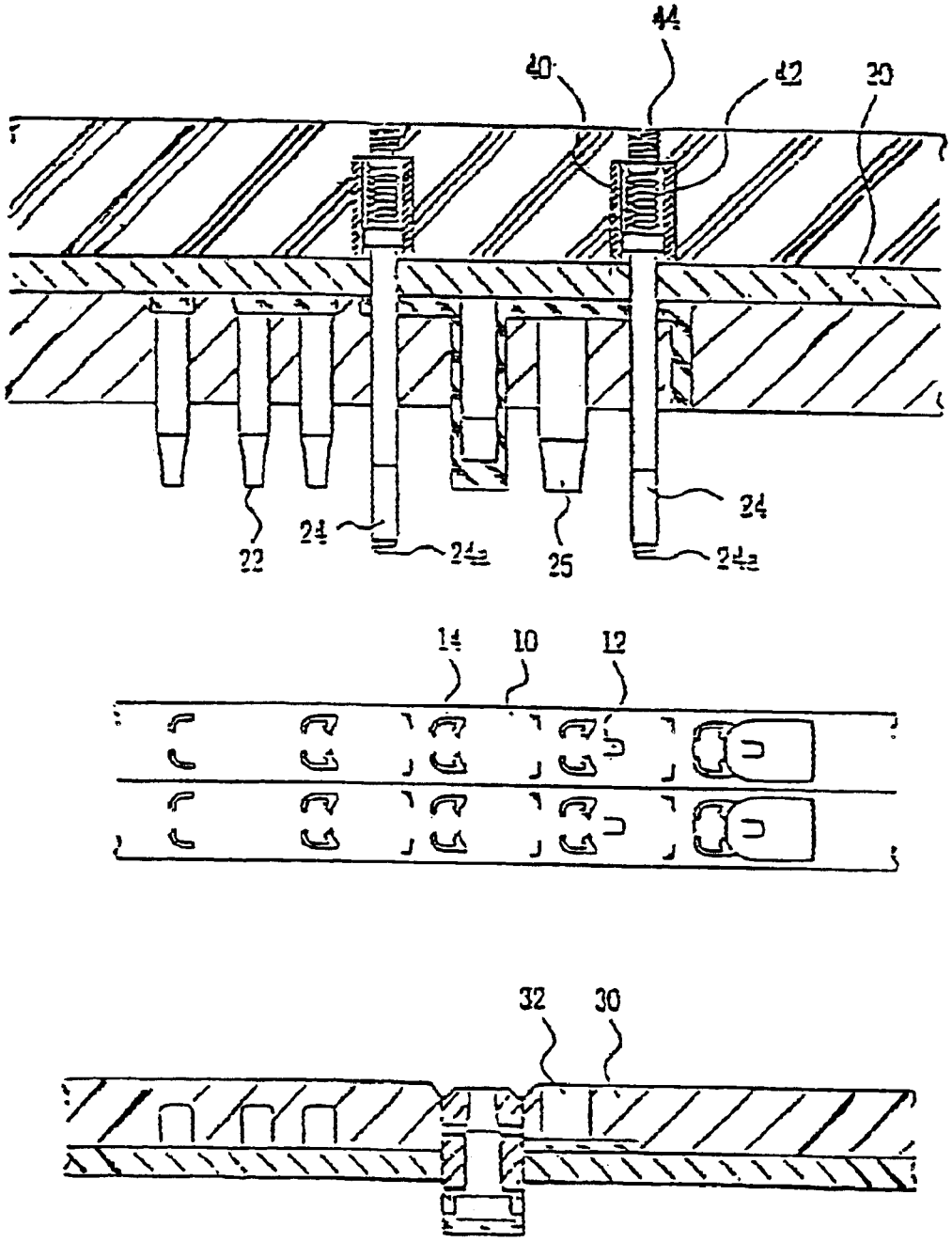
FIG. 2 is a sectional view of an apparatus for manufacturing a designed aluminum tab of a beverage can according to the present invention.
Figure 3:
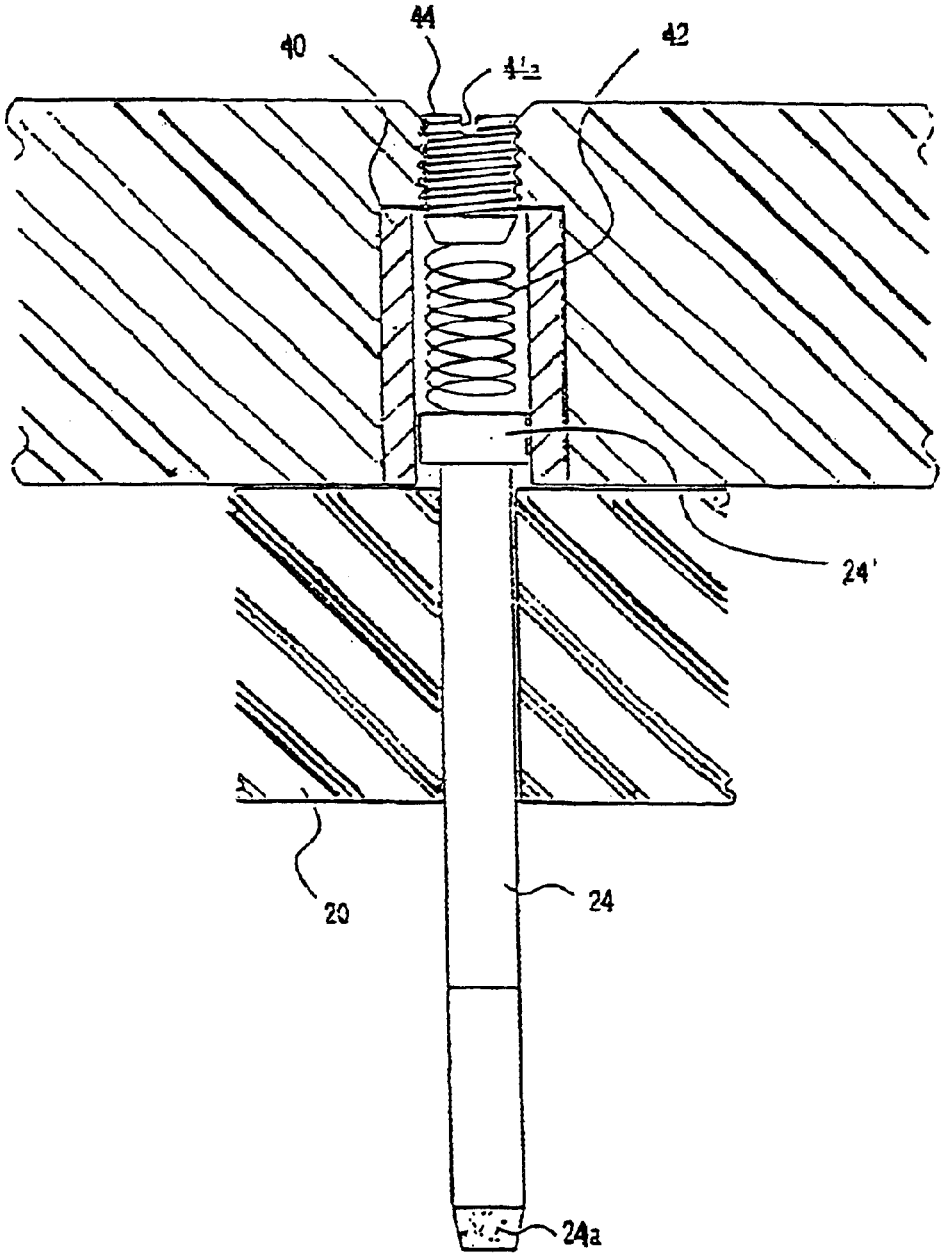
FIG. 3 is an enlarged sectional view of a pilot pin employed in the present invention.

FIG. 2 is a sectional view of an apparatus for manufacturing a designed aluminum tab of a beverage can in accordance with the present invention, and FIG. 3 is an enlarged sectional view of a pilot pin employed in the present invention.

In order to secure the space to apply the design when forming the tab of which curling part is close, the preferred embodiment of the present invention employs, not the conventional pilot pins and matching holes, but a pressing means disposed on the upper part of the pilot pin, for pressing the tab not be moved only when the tab is formed.

The pressing means is comprised of a casing 40 formed on the upper part of the pin 24, and a spring 42 disposed in the casing 40 to press the upper part of the pilot pin 24 downwardly.

As the pilot pin 24 is pressed downwardly by the spring 42, when the upper mold 20 is contacted with the lower mold 30 by the downward movement thereof for the forming process, the lower end of the pilot pin 24 is contacted with the surface of the tab coil 10 placed on the lower mold 30. In such a situation, the lower end of the pin 24 cannot move downward any more by the lower mold 30, and begins to move upward against the force of the spring 42. While the pilot pin 24 is moving upward against the spring 42, the lower end of the pilot pin 24 is pressing the surface of the tab coil 10 continuously by the elastic force of the spring 42.

Meanwhile, a buffering member 24*a* such as a sponge or a synthetic resin is attached to the lower end of the pilot pin 24, which prevents sliding in the forming process of high speed and improves the contacting force to the tab coil 10 to raise the exactness of forming.

As described above, the forming process of high exactness can be achieved by pressing the tab coil 10 with the pilot pin 24 steadfastly during the forming of the tab, however, it is necessary to adjust the pressing force to the tab coil 10 by adjusting the distance between the upper mold 20 and the lower mold 30, the tension of the spring 42, or the length of the pilot pin 24.

For such an adjustment, an adjusting bolt 44 is screwedly assembled with the upper part of the casing 40. Since the adjusting bolt 44 is assembled with the upper part of the casing 40 while pressing the spring 42, if required, as shown in FIG. 3, the adjusting bolt 44 can be released by using a tool such as a driver inserted into the recess 44*a* of the adjusting bolt 44, in order to adjust the elastic force of the spring 42. Then, the pressing force of the spring 42 applied to the upper end 24' of the pilot pin 24 during the forming is changed, so the pressing force of the pin 24 can be adjusted properly.

As the tab forming apparatus is used for the present invention, when the tab for the beverage can of which curling part is close is formed to secure the space to print the design, by pressing the tab coil with the pilot pin pressed in the casing by the spring, the movement of the tab is prevented to achieve the exact forming, and by changing the pressing force of the pilot pin applied to the tab, the proper pressure can be maintained continuously.

According to the present invention, in case of the tab of which curl part is close, the printing process is performed while the position of the base color painted on the surface of the coil is arranged to a desired position of the tab to be formed afterwards exactly with the pitch arrangement tool. Then, the varnish coating process of the tab coil printed with the design is performed at the same pitch as the printing process, and then the tab is formed and stacked with the same pitch, whereby the painting process of the base color, the printing process of the design, and the varnish coating process for preserving the printing quality are performed by a unified design tab printer, and then the tab forming process and the stacking process are performed by the conversion press, which improves the productivity and exactness.

Although the preferred embodiment of the present invention has been described, it will be understood by those skilled in the art that the present invention should not be limited to the described preferred embodiment, but various changes and modifications can be made within the spirit and the scope of the present invention. Accordingly, the scope of the present invention is not limited within the described range but the following claims.

What is claimed is:

1. A method for manufacturing a design tab end of a beverage can, comprising the steps of:

painting a base color on an exact surface position of an aluminum tab coil that is to be formed to a tab through a tab forming process;

printing a design on the surface of the tab coil on which the base color has been painted, according to a printing degree;

coating a varnish for preventing a deterioration of printing quality during forming and distribution of a product, on the surface of the tab coil on which the design has been printed;

arranging a pitch of the tab coil so as to determine an exact position of the tab coil that has been coated with the varnish;

press-forming the arranged tab coil with a conversion press; and stacking the tab formed by the press-forming to join the tab on a center of a shell that has been fed previously, wherein the step of painting the base color, the step of printing the design, and the step of coating to preserve the printing quality are performed in a single process by a unified design tab printer using a pitch arrangement tool.

2. The method for manufacturing a design tab end of a beverage can according to claim 1, wherein the tab coil is fed to the step of painting the base color through a photosensitive printing layer and a pitch roll.

* * * * *

UNITED STATES PATENT AND TRADEMARK OFFICE

CERTIFICATE OF CORRECTION

PATENT NO. : 6,854,947 B2
DATED : February 15, 2005
INVENTOR(S) : Lee

It is certified that error appears in the above-identified patent and that said Letters Patent is hereby corrected as shown below:

Title page,
Item [73], Assignee, replace "LG Electronics" with -- C-Solution --.

Signed and Sealed this

Seventeenth Day of May, 2005

JON W. DUDAS
*Director of the United States Patent and Trademark Office*